US006718950B2

(12) United States Patent
Hu et al.

(10) Patent No.: US 6,718,950 B2
(45) Date of Patent: Apr. 13, 2004

(54) ELECTRICALLY DRIVEN HYDRAULIC PUMP SLEEVE ACTUATOR

(75) Inventors: Haoran Hu, Novi, MI (US); Bryan E. Nelson, Lacon, IL (US)

(73) Assignee: Caterpillar Inc., Peoria, IL (US)

( * ) Notice: Subject to any disclaimer, the term of this patent is extended or adjusted under 35 U.S.C. 154(b) by 94 days.

(21) Appl. No.: 10/020,430

(22) Filed: Dec. 14, 2001

(65) Prior Publication Data

US 2003/0111059 A1 Jun. 19, 2003

(51) Int. Cl.[7] ..... F02M 37/04
(52) U.S. Cl. ..... 123/497; 251/129.11
(58) Field of Search ..... 123/497, 499, 123/446; 417/269; 251/129.11

(56) References Cited

U.S. PATENT DOCUMENTS 5,061,155 A * 10/1991 Masaoka et al. ..... 417/269
5,138,291 A * 8/1992 Day ..... 335/258
5,362,209 A * 11/1994 Day ..... 417/293
5,809,157 A * 9/1998 Grumazescu ..... 381/412
6,035,828 A * 3/2000 Anderson et al. ..... 123/446
6,216,670 B1 * 4/2001 Anderson et al. ..... 123/446
6,435,472 B1 * 8/2002 Najmolhoda et al. ..... 251/50

* cited by examiner

*Primary Examiner*—Mahmoud Gimie
(74) *Attorney, Agent, or Firm*—Thomas L Derry

(57) ABSTRACT

A hydraulically-actuated system includes a fix displacement variable delivery pump with a plurality of parallel disposed pistons that reciprocate in a pump housing the defines a high pressure portion and a low pressure area. A control device is attached to the pump housing and moveable between a first position in which the pistons displace fluid into the high pressure portion and a second position in which pistons spill fluid back to the low pressure area. The control device includes an electrically driven linear motion device, a linkage and a plurality of sleeves, one being disposed on each piston. Linear movement of the control device in turn causes linear movement of the sleeves. The position of the sleeves in turn determines the amount of output of the pump.

17 Claims, 4 Drawing Sheets

ELECTRICALLY DRIVEN HYDRAULIC PUMP SLEEVE ACTUATOR

TECHNICAL FIELD

The present invention relates generally to hydraulically-actuated system, and more particularly to a electrically driven actuator of a variable delivery fixed displacement pump.

BACKGROUND ART

U.S. Pat. No. 6,035,828 to Anderson et al. describes a variable delivery actuating fluid pump for a hydraulically-actuated fuel injection system. In this system, a high pressure rail supplies pressurized lubricating oil to a plurality of hydraulically-actuated fuel injectors mounted in a diesel engine. The high pressure rail is pressurized by a variable delivery fixed displacement type pump that is driven directly by the engine. Pump pressure control is provided by hydraulically varying the high pressure output of the pump. This is accomplished by providing a piston arrangement in the pump that incorporates a moveable sleeve on the outside of the pistons. Depending upon the position of the sleeve, a spill port on the piston can be opened or closed. When the spill port is opened, the fluid is spilled back into the low pressure side of the pump, instead of being pushed into the high pressure rail. The position of the sleeve is maintained by a hydraulic actuator. Fluid in the actuator moves an actuator shaft, which in turn moves the sleeve.

While the Anderson et al. hydraulically-actuated system using a variable delivery pump performs better than previous systems, there remains room for improvement. The complicated mechanical structure of the pump and hydraulic actuator provides potential leak paths for hydraulic fluid. Also, because the viscosity of lubricating oil varies due to temperature, control of the pump may be sluggish when the oil is of an extremely cold temperature.

The present invention is directed to overcoming problems associated with, and improving upon, hydraulically-actuated systems of the prior art.

SUMMARY OF THE INVENTION

In a first aspect of the invention, a fixed displacement variable delivery pump is provided. The pump includes a housing, a plurality of pistons and a control device. A linear motion device that is moveable in responses to electrical energy is provided. A linkage connects the linear motion device to a plurality of sleeves on the pistons. Movement of the linear motion device in turn moves the sleeves and varies the output of the pump.

In another aspect of the invention an electrically driven linear motion device for a fixed displacement variable delivery pump is provided. The linear motion device includes a body, a piston slidably disposed in the body, a sleeve disposed about the piston, a field coil, an armature and a linkage moving the sleeve relative to said piston in response to movement of the armature.

In yet another aspect of the invention a fluid delivery system is provided. The fluid delivery system includes a fixed displacement variable delivery pump having a piston, a sleeve disposed about the piston and a high pressure outlet. An electrically driven linear motion device is connected to the sleeve and moves the sleeve relative to the piston. A high pressure rail is connected the high pressure outlet and a pressure sensor, for delivering a pressure signal is connected to the high pressure rail. An electronic control module is connected to the linear motion device and delivers a drive signal in response to a reviewing the pressure signal.

DETAILED DESCRIPTION

Figure 1:
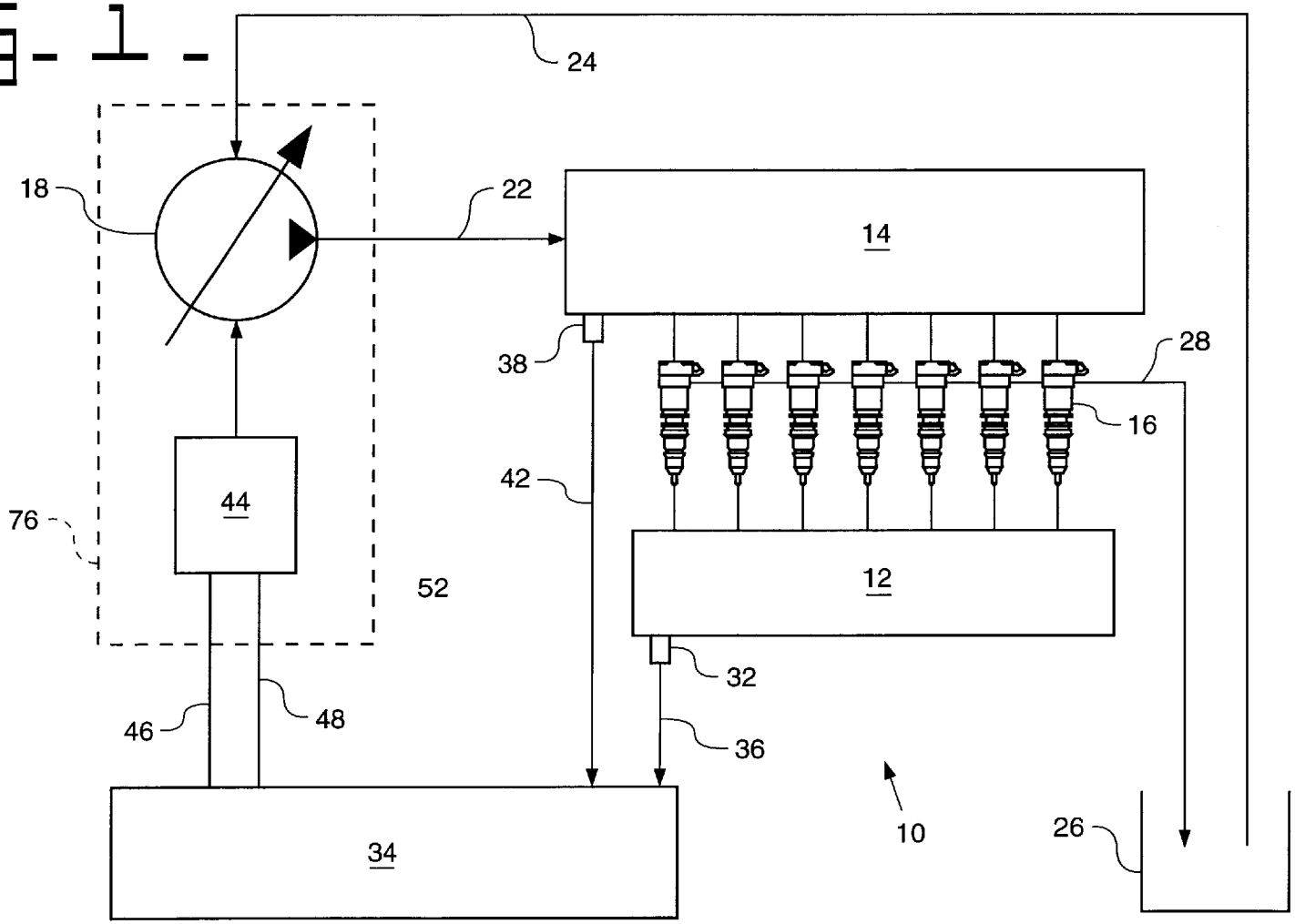
FIG. 1 is a schematic illustration of a hydraulically-actuated system according to the present invention.

Referring now to FIG. 1, a hydraulically actuated system 10 is attached to an internal combustion engine 12. The hydraulically actuated system 10 includes a high pressure rail 14 that supplies high pressure actuation fluid to a plurality of hydraulically-actuated devices, such as hydraulically-actuated fuel injectors 16. Those skilled in the art will appreciate that other hydraulically-actuated devices, such as actuators for gas exchange valves for exhaust brakes, could be substituted for the fuel injectors 16 illustrated in the example embodiment. The high pressure rail 14 is pressurized by a variable delivery fixed displacement pump 18 via a high pressure supply conduit 22. The pump 18 draws actuation fluid along a low pressure supply conduit 24 from a source of low pressure fluid, which is preferably the engine's lubricating oil sump 26. Although other available liquids could be used, the present invention preferably utilizes engine lubricating oil as its hydraulic medium. After the high pressure fluid does work in the individual fuel injectors 16, the actuating fluid is returned to sump 26 via a drain passage 28.

As is well known in the art, the desired pressure in the high pressure rail 14 is generally a function of the engine's 12 operating condition. For instance, at high speeds and loads, the rail pressure is generally desired to be significantly higher than the desired rail pressure when the engine 12 is operating at an idle condition. An operating condition sensor 32 is attached to engine 12 and periodically provides an electronic control module 34 with sensor data, which includes engine speed and load conditions, via a communication line 36. In addition, a pressure sensor 38 periodically provides electronic control module 34 with the measured fluid pressure in common rail 14 via a communication line 42. The electronic control module 34 compares a desired rail pressure, which is a function of the engine operating condition, with the actual rail pressure provided by pressure sensor 38.

If the desired and measured rail pressures are different, the electronic control module commands movement of a control device 44 via a control line 46. A signal line 48 from the control device to the electronic control module may be included. The signal line 48 is used to inform the electronic control module 34 of the axial position of the control device 44. The control device 44 includes an electrically driven actuator 52 coupled to a plurality of moveable sleeves 54 by a linkage 56. The moveable sleeves 54 are arranged to open and close a of spill port 58 disposed on each of a plurality of pistons 62 within the pump 18. When the spill ports 58 are opened, fluid is permitted to bypass a high pressure portion 64 of the pump. The electronically driven actuator 52 of the present invention is generically an electrically driven linear motion device 44. The linear motion device may be of any conventional construction. Various embodiments are described hereafter by way of example. A position sensor 88 may be either integral of the linear motion device 66 or attached to any portion of the control device 44. In either case the position sensor 88 is adapted to provide data to the electronic control module 34 related to the axial position of the control device 44. Additional electronic circuitry may be utilized in combination with the electronic control module 34 and the control device 44 to indicate the presence of electronic faults within the system.

Figure 2:
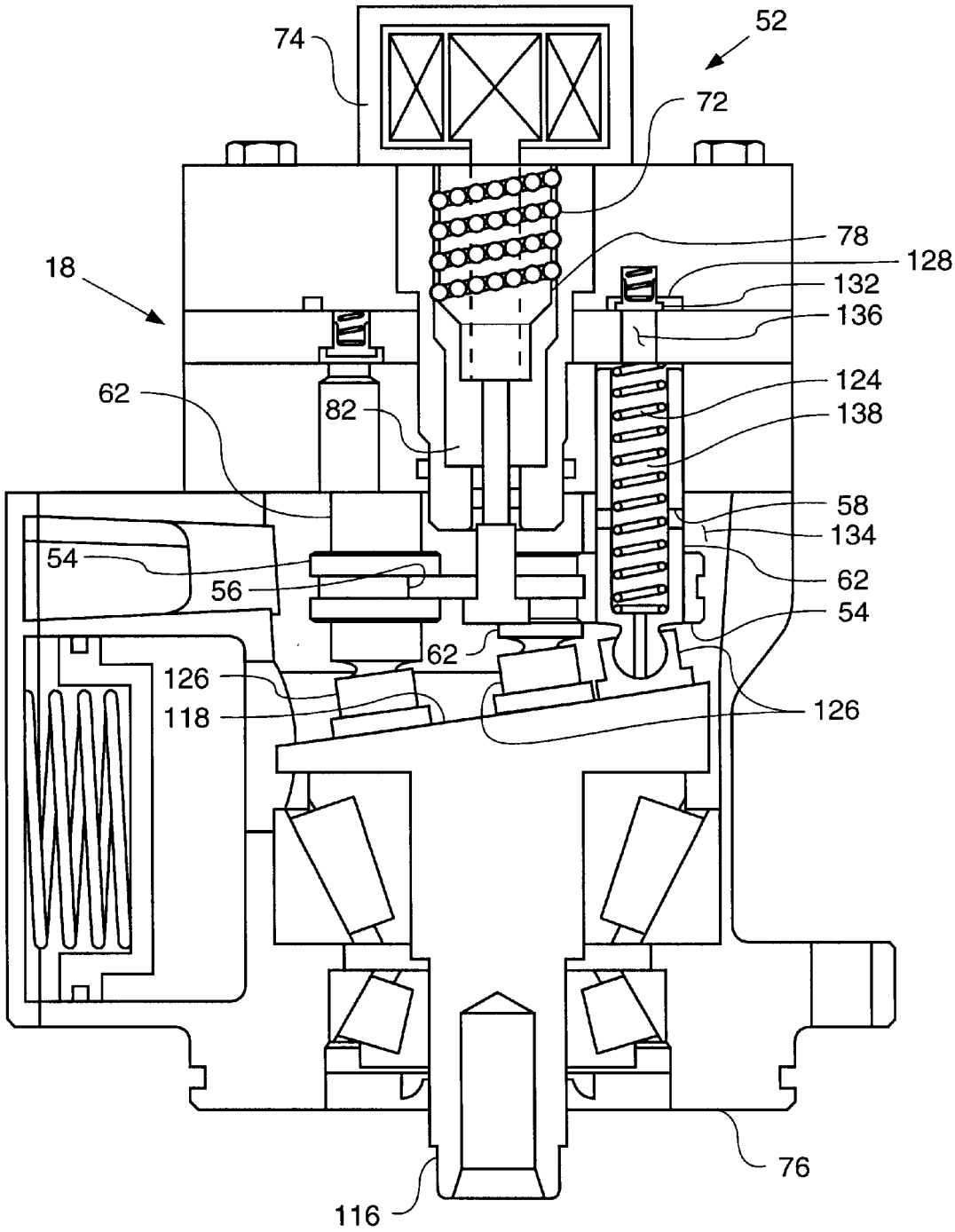
FIG. 2 is a sectioned side diagrammatic view of a fixed displacement pump according to one aspect of the present invention.

A first embodiment of the invention, a ball screw 72 coupled to an electric motor 74 provides axial movement for the control device 44. The ball screw 72 and electric motor 74 are well known and therefore will not be discussed in detail. Generically, ball screw 72 refers to a mechanical device capable of translating rotational movement into linear movement. The ball screw 72 and electric motor 74 may be attached to a pump housing 76 in a number of manners. One such example, the ball screw 72 may be include as a cylindrical member 78 as illustrated in FIG. 2. The cylindrical member 78 being adapted to be received by the pump housing 76. The ball screw 72 being mechanically coupled to the sleeves 54 by a linkage 82. The electric motor 74 being fixedly attached to the pump housing 76 and drivingly engaging the ball screw 72. The electric motor 74 being attached to the control line 46 and the signal line 48 of the electronic control module 34. The electronic control module 34 provides power to rotate the electric motor 74 in a first or second direction. Rotation of the electric motor 74 causes axial movement of the control device 44.

Figure 3:
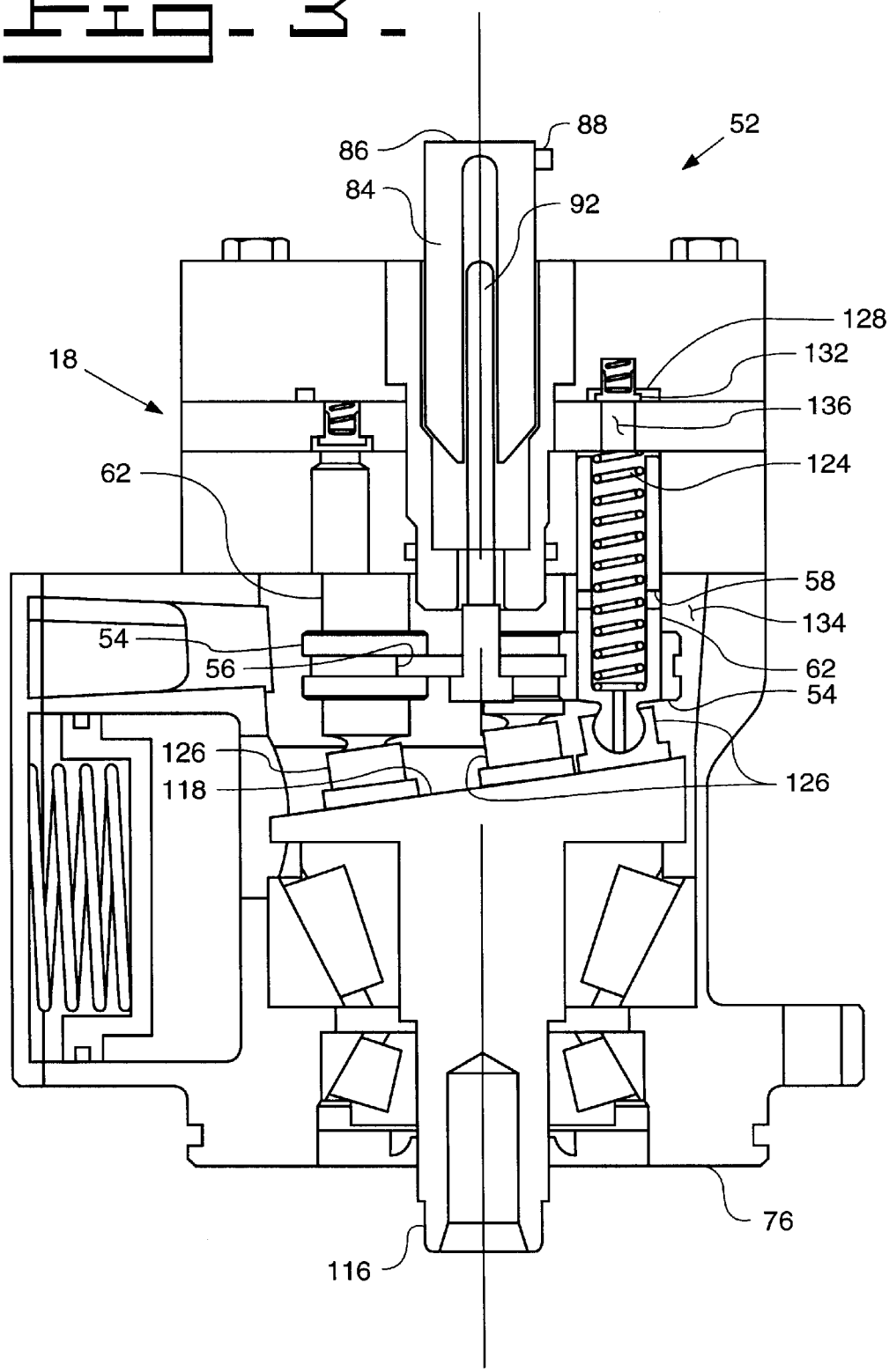
FIG. 3 is a sectioned side diagrammatic view of a fixed displacement pump according to another aspect of the present invention.
Figure 4:
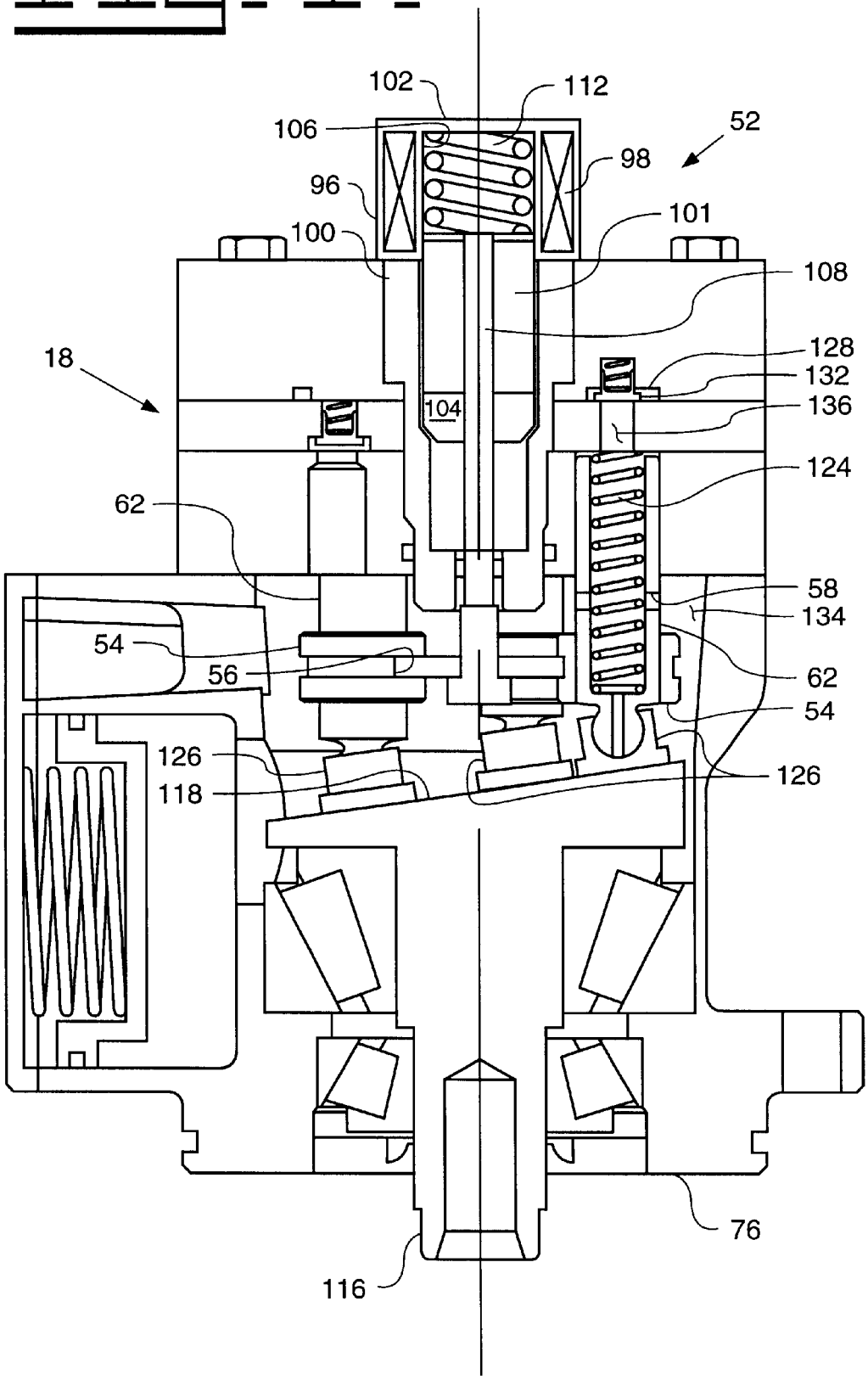
FIG. 4 is a is a section side diagrammatic view of a fixed displacement pump according to yet another aspect of the present invention.

Referring to FIG. 3, another embodiment of the invention, a linear motor 84 provides axial movement of the control device 44. The linear motor 84 includes a body 86, an electrical connector 88 and a shaft 92 disposed within the body 86. The shaft 92 is moveable between a first position and a second position in response to electrical current from the electronic control module 34. The linear motor 84 may further include a position sensor 68 capable of providing an electronic signal relative to the axial position of the shaft 92 and sleeves 54 with reference to the body 86.

Referring to yet another aspect of the invention, a proportional solenoid 94 provides linear movement for the control device 44. The proportional solenoid 94 includes a body 96, a coil 98, and a armature 101. The body 96 is a substantially cylindrical member 100 having a first end 102, a second end 104 and a bore 106. The coil 98 is an electrically conductive winding disposed in the bore 106 nearest the first end 102. The armature 101 is a substantially cylindrical member moveably positioned within the bore 106. A shaft 108 of the armature extends from the second end 104 of the body 96. The linkage 82 of the control device mechanically couples the shaft 108 of the armature 101 to the sleeves 54. A spring 112 disposed within the body 96 biases the armature 101 away from the coil 98.

Various other features of pump 16 are contained within a pump housing 76. Pump 18 includes a rotating pump shaft 116 that is coupled directly to the engine 12, such that the rotation rate of the pump shaft 116 is directly proportional to the crank shaft (not shown) of the engine 12. A fixed angle swash plate 118 is attached to the pump shaft 116. The rotation of swash plate 118 causes the plurality of parallel disposed pistons 62 to reciprocate from left to right. In this example, the pump 18 includes five pistons 62 that are continuously urged toward the swash plate 118 by individual return springs 124. The return springs 124 maintain shoes 126, which are attached to one end of each piston 62 in contact with the swash plate 118 in a conventional manner. Because the swash plate 118 has a fixed angle, the pistons 62 reciprocate through a fixed reciprocation distance with each rotation of the pump shaft 116. Thus, the pump 18 can be thought of as a fixed displacement pump 18. However, the electrically driven actuator 52 determines whether the fluid displaced is pushed into a high pressure outlet 128 past a check valve 132 or spilled back into a low pressure portion 134 via a spill port 58.

Pressure within a pumping chamber 136, under each piston 62, can only build when an internal passage 138 and the spill port 58 are covered by a sleeve 54. When the sleeve 54 covers the spill port 58, fluid displaced by the piston 62 is pushed past the check valve 132, into a high pressure outlet 128, and eventually out of the high pressure outlet 128 to the high pressure common rail 14. When the pistons 62 are undergoing the retracting portion of their stroke due to the action of the return spring 124, low pressure fluid is drawn into pumping chamber 136 from the low pressure portion 134 within the pump housing 76 past an inlet check valve 142.

The internal passage 138 within each piston 62 extends between its pressure face end 144 and its side surface 146. In this embodiment, the height of the individual sleeves 54 is about equal to the fixed reciprocation distance of pistons 62. In this way, when sleeve 54 is in the position shown in FIG. 5*a*, all of the fluid displaced by the piston 62 is pushed into the high pressure portion 64 within the pump 18. On the other hand, when the sleeve 54 is in the position shown in FIG. 5*b*, virtually all of the fluid displaced by the piston 62 is spilled back into low pressure portion 134 within the pump 18 via internal passage 138 and spill port 58. Thus, the pump 18 can be characterized as variable delivery since the high pressure output is variable, but also be characterized as a fixed displacement swash plate type pump since the pistons always reciprocate a fixed distance.

Industrial Applicability

Referring now to the FIGS. the operation of hydraulically-actuated system 10 having an electrically driven actuator 52 will be described. An internal combustion engine 12 drives a fixed displacement variable delivery pump 18. The pump 18 draws fluid from a lubricating oil sump 26 into a low pressure portion 132 of the pump 18. Rotation of a plurality on pistons 62 around a shaft 116 in the pump 18, causes the pistons 62 to move in an axial direction. Movement of the pistons 62 is caused by a fixed angle swash plate 118. The pistons 62 move between a first position, and a second position nearest a high pressure outlet 128. In the first position fluid flows from the low pressure portion 134 of the pump 18 into the piston 62. As the piston 62 moves toward the second position, fluid is pushed into a high pressure portion 64 of the pump 18. A control device 44 controls the amount of fluid output from the piston 62 to the high pressure portion 64 of the pump 18. An electronic control module 34 sends a signal to the electrically driven actuator 52 via a control line 52.

The electronic control module 34 receives a signal from a pressure sensor 38 located in the high pressure common rail 14 via a communication line 42. Additionally, the electronic control module 34 receives a signal from an operating condition sensor 32 on the internal combustion engine 12 via communication line 36. The operating condition sensor 32 signals the electronic control module 32 the status of a plurality of operating parameters of the internal combustion engine 12. Based on the need to alter fluid pressure in the high pressure common rail 14 the electronic control module 32 commands movement of the electronically driven actuator 52.

The present invention decreases the complexity of prior art hydraulically-actuated systems by providing a signal electrically driven actuator 52 for controlling pressure in the high pressure rail 14. Reponses time of the electrically driven actuator 52 is not as greatly effected by the temperature of oil as with prior systems. Faster pump 18 control during lower temperature operation improves emissions output of the internal combustion engine 12. Additionally, the elimination of a number of pump 18 components and fluid seals within the pump 18 reduces the possibility of oil leakage from the pump 18.

The above description is intended for illustrative purposes only, and is not intended to limit the scope of the present invention in any way. For instance, other types of actuators could be substituted for the example illustrated actuator without departing from the intended scope of the present invention. Thus, those skilled in the art will appreciate that various modifications can be made to the illustrated embodiment without departing from the spirit and scope of the present invention, which is defined in terms of the claims set forth below.

What is claimed is:

1. A fixed displacement variable delivery fluid pump having a housing, a plurality of pistons each having a spill port and a control device comprising:

a linear motion device which includes a portion that is movable in response to said linear motion device receiving electrical energy;

a sleeve movably positioned about each of said pistons; and a linkage connecting said portion of said linear motion device to each of said sleeves, and said sleeves moving with said portion and in a direction axially relative to said piston.

2. The control device of claim 1, wherein said linear motion device includes a ball screw mechanism being connected to and driven by a rotary electric motor.

3. The control device of claim 1, wherein said liner motion device includes a linear electric motor.

4. The control device of claim 1, wherein said liner motion device includes a proportional solenoid.

5. The control device of claim 1, wherein said electrically driven linear motion device being disposed in a cavity in said pump housing.

6. The control device of claim 1, wherein said electrically driven linear motion device being disposed remotely of said pump housing.

7. A fixed displacement variable delivery fluid pump having a housing, a plurality of pistons each having a spill port and a control device comprising:

a linear motion device being movable in response to receiving electrical energy;

a sleeve movably positioned about each of said pistons;

a linkage connecting said linear motion device to each of said sleeves, and moving said sleeves axially relative to said piston in response to movement of said linear motion device; and a position sensor connected to sense the position of said sleeve and deliver a responsive position signal.

8. An electrically driven linear motion device for a fixed displacement variable delivery pump comprising:

a body;

a piston slidably disposed in said body;

a sleeve disposed about said piston;

a field coil disposed within said body;

an armature moveably disposed within said body; and a linkage connecting said armature to said sleeve, and said sleeve moving with said armature relative to said piston.

9. The electrically driven linear motion device of claim 8 wherein said linkage mechanism including a ball screw mechanism connecting said armature to said sleeve.

10. The electrically driven linear motion device of claim 8 including a shaft connected to a spring biasing said shaft in a first direction.

11. The electrically driven linear motion device of claim 8 wherein said device includes a linear motor.

12. The electrically driven linear motion device of claim 8 wherein said device includes a proportional solenoid.

13. An electrically driven linear motion device for a fixed displacement variable delivery pump comprising:

a body;

a piston slidably disposed in said body;

a sleeve disposed about said piston;

a field coil disposed within said body;

an armature moveably disposed within said body; and a linkage connecting said armature to said sleeve and moving said sleeve relative to said piston in response to movement of said armature; and a position sensor connected to and delivering a signal related to a position of said armature.

14. A fluid delivery system comprising:

a fixed displacement variable delivery pump having a piston, a sleeve disposed about said piston and a high pressure outlet;

a linear motion device with a movable portion connected to said sleeve and being actuatable to move said moveable portion with said sleeve relative to said piston, and said linear motion device being electrically driven;

a high pressure rail connected to said high pressure outlet; a fluid pressure sensor connected to said high pressure common rail and being adapted to deliver a pressure signal responsive to said fluid pressure in said rail being at a predetermined value; and an electronic control module being connected to said electrically driven linear motion device and said fluid pressure sensor, said electronic control module being adapted to deliver a drive signal to said electrically driven linear motion device in response to reviewing said fluid pressure signal.

15. The fluid delivery system of claim 14 including a fuel injector connected to said high pressure rail.

16. The fluid delivery system of claim 14 including an operating condition sensor for communicating an operating condition signal of an internal combustion engine to said electronic control module and said electronic control module altering said drive signal to said electrically driven linear motion device responsive to said operating condition signal.

17. A fluid delivery system comprising:

a fixed displacement variable delivery pump having a piston, a sleeve disposed about said piston and a high pressure outlet;

a linear motion device connected to said sleeve and being actuatable to move said sleeve relative to said piston, said linear motion device being electrically driven;

a high pressure rail connected to said high pressure outlet;

a fluid pressure sensor connected to said high pressure common rail and being adapted to deliver a pressure signal responsive to said fluid pressure in said rail being at a predetermined value;

an electronic control module being connected to said electrically driven linear motion device and said fluid pressure sensor, said electronic control module being adapted to deliver a drive signal to said electrically driven linear motion device in response to reviewing said fluid pressure signal; and said electrically driven linear motion device includes a position sensor for communicating a sleeve position signal to the electronic control module and said electronic control module altering said drive signal to said electrically driven linear motion device responsive to said position signal.

* * * * *